US005499822A

United States Patent [19]

Sabourin

[11] Patent Number: 5,499,822

[45] Date of Patent: Mar. 19, 1996

[54] SOCCER GAME FOR USE IN SWIMMING POOLS

[76] Inventor: Guy Sabourin, 63 Bella Vista, St. Basile-le-Grand, Quebec, Canada, J3N 1L1

[21] Appl. No.: 359,553

[22] Filed: Dec. 20, 1994

[51] Int. Cl.[6] ..... A63B 67/00

[52] U.S. Cl. ..... 273/411; 273/58 H; 273/348; 273/400; 273/402

[58] Field of Search ..... 273/411, 58 H, 273/348, 350, 349, 398, 400, 401, 402, 406, 407

[56] References Cited

U.S. PATENT DOCUMENTS

| | | | |
|---|---|---|---|
| 3,582,078 | 6/1971 | Katras et al. | 273/411 |
| 3,843,127 | 10/1974 | Lack | 273/349 |
| 4,307,887 | 12/1981 | Weiss | 273/411 |
| 4,786,053 | 11/1988 | Barnes, Jr. | 273/411 X |
| 4,917,381 | 4/1990 | Spector | 273/58 H |
| 5,244,213 | 9/1993 | Armell | 273/400 |
| 5,335,907 | 8/1994 | Spector | 273/58 H |
| 5,375,849 | 12/1994 | Sabourin | 273/411 |

*Primary Examiner*—William H. Grieb
*Attorney, Agent, or Firm*—Eric Fincham

[57] ABSTRACT

A soccer type game for playing in a swimming pool, the game including first and second goals formed of a material having a density sufficient to permit the goals to lie on the bottom of the pool, and a soccer type ball filled with water and also having a density sufficient to remain on the bottom of the pool.

6 Claims, 1 Drawing Sheet

SOCCER GAME FOR USE IN SWIMMING POOLS

BACKGROUND OF THE INVENTION

The present invention relates to an amusement device and more particularly relates to a soccer type game adapted to be played in a swimming pool.

Above ground swimming pools are relatively inexpensive and accordingly, are widely available and used. However, due to their limited depth (usually four feet or so) a number of activities which would normally be enjoyed in larger swimming pools and inground swimming pools are not suitable. Thus, for example, these pools are generally not suitable for diving and/or swimming of any distance.

However, pools are still considered desirable for cooling off on a hot day and for relaxation purposes. There have been a number of adaptations of games for such pools and these have included versions of games such as basketball and/or volleyball. Examples of such games are disclosed in, for example, U.S. Pat. No 3,582,078 which teaches a hoop ball type of arrangement; U.S. Pat. No. 4,307,887 which teaches the combination of a pair of basketball backboards with a volley ball net suspended therebetween; and applicant's co-pending application Ser. No. 08/169,990, now U.S. Pat. No. 5,375,849 which relates to a volley ball type of game.

While such games can be enjoyable, there is always a demand for different types of games which can be played in swimming pools and particularly, in above ground swimming pools.

SUMMARY OF THE INVENTION

It is an object of the present invention to provide a soccer type game which can be utilized in above ground swimming pools.

It is a further object of the present invention to provide a game for a swimming pool which can be played by two or more people and which is relatively inexpensive.

It is a further object of the present invention to provide a soccer type game for a swimming pool wherein the game may be readily set-up and played.

According to one aspect of the present invention, there is provided a kit for a soccer type game for a swimming pool, the kit comprising first and second goals with each of first and second goals being formed of a material of a density sufficient to remain on the bottom of the swimming pool. A soccer type ball having a cover surrounding an interior space is provided. Valve means associated with said ball permit the introduction of a fluid therein. The kit includes valve adaptor means which comprise a member having a first end thereof adapted for introduction into the valve means on said ball and having a fluid outlet proximate the first end. A second end of the adaptor is designed to be connected to a source of water to thereby permit the introduction of water into the interior of the ball.

In another aspect of the invention, there is provided a pool game assembly comprising first and second goals, the first and second goals being adapted to sit on the bottom of a pool. There is also provided a ball, the ball having an interior filled with water, the filled ball having a density at least slightly greater than the density of the pool water such that the ball will naturally tend to fall to the bottom of the pool.

In greater detail, the present invention provides a soccer like game which can be played in a pool, either in a typical above ground pool or in the shallow end of an inground pool.

As above mentioned, there are provided a pair of goals which may be placed as desired at opposed ends/sides of the pool. The goals may take various different configurations ranging from a replica of a conventional soccer goal to a member having the outline of a goal sized area, the member being formed of a suitable material so as to lie on the pool base or floor. To this end, the goals will be formed such that there is sufficient mass that they will stay on the bottom of the pool. The goals may be formed of a material which has the required density or in the alternative, weights may be employed.

Naturally, the size and exact configuration of the goals may vary with a preferred size being in the order of a width of approximately 24 inches and a depth of approximately 12 inches. Naturally, preferably the goals are formed of a material which is non-corrosive and will be adapted to the typical environmental considerations for a swimming pool—i.e. chlorine resistant.

Furthermore, the goals should be designed to be readily visible and as such, may incorporate reflective material and/or be coloured for the desired effect.

The ball may be manufactured in many different formats. A preferred arrangement is one which resembles the conventional soccer ball—i.e. a black and white pattern. The ball is designed such that when it is filled with water, it will have a density at least slightly greater than the density of the pool water such that it will have the tendency to remain on the floor of the pool. This may be accomplished in several different ways including providing a slightly heavy mixture to be placed in the interior of the ball or having the ball covering of a material which is slightly denser than the water. This is the preferred arrangement since utilizing other liquids in the ball runs the risk of contamination of the pool should a leak occur.

The kit provided for the game desirably includes means for filling the ball with a fluid and particularly water. As is well known in the art, inflatable balls are provided with a valve structure which will normally permit filling of the ball with air while preventing loss of pressure therefrom. The present invention contemplates the use of such a standard valve arrangement and to this end, there is provided a special adaptor which has one end adapted to cooperate with the valve structure to permit the ingress of the liquid. The conventional arrangement is known in the art—i.e. having a valve stem with one or more apertures at an end thereof, the valve stem being adapted to pass through the valve structure while sealingly engaging the side to prevent egress of material from the ball when filling.

The other end of the valve adaptor would include means for providing a fluid to pass through the valve stem. In one convenient arrangement, the structure may be such that the other end is provided with conventional threads adapted to mate with the thread structure of a typical garden hose.

Having thus generally described the invention, reference will be made to the accompanying drawings illustrating an embodiment thereof, in which.

Figure 2:
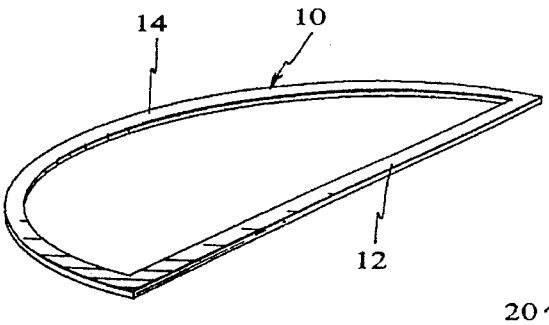
FIG. 2 is a perspective view of one embodiment of a goal according to the present invention.
Figure 3:
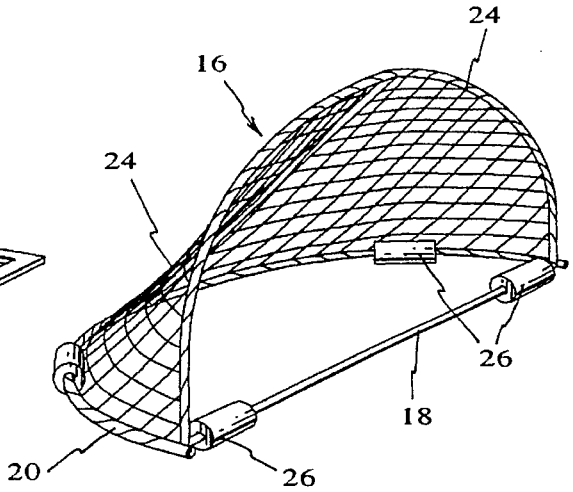
FIG. 3 is a perspective view of a further embodiment of a goal according to the present invention.

Referring to the drawings and by reference characters thereto, FIGS. 2 and 3 illustrate two different types of goals which may used in the present invention. In FIG. 2, a goal 10 comprises a front piece 12 and a rear semi-circular piece 14. Pieces 12 and 14 may either be formed as a single unit or suitably secured together. Each piece is rectangular in cross-section and preferably is formed of a sufficiently dense material such that it will remain on the bottom of the pool. A preferred material would be a flexible rubber material adapted to resist pool chemicals.

In the embodiment of FIG. 3, goal 16 is formed of a front bar 18, a semi-circular or hemispherical rear bar 20 and a net support bar 22. As will be noted, a net 24 is entrained about rear bar 20 and net support bar 22 in a conventional manner. A plurality of weights/protective devices 26 may be utilized to again ensure that net 16 remains on the pool bottom.

Figure 4:
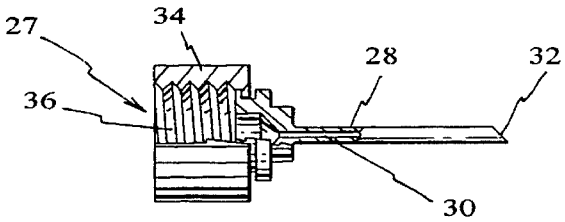
FIG. 4 is a view, partially in section, of a valve adaptor utilized with the invention.

FIG. 4 illustrates a valve adaptor as may be employed with a conventional ball. Valve adaptor 27 includes a valve stem 28 having an interior shaft 30 with an outlet 32. A body portion 34 includes interior threads 36 surrounding an inlet 38. Valve stem portion 28 and body portion 34 may be formed as a single unit or alternatively, may be formed as separate members suitably secured together.

Valve stem 28 is adapted to penetrate the valve in a standard ball in a conventional manner. Threads 36 on body 34 are adapted to mate with the threads on a conventional hose.

In filling the ball, originally valve stem 28 of adaptor 27 is introduced into the valve of a conventional ball B. The ball is then deflated removing as much of the air from the interior of the ball as possible. Subsequently, the adaptor is screw threadably engaged with a water hose and water is allowed to enter the ball until it is substantially completely filled.

After being filled the first time, the hose may then be disconnected and with the adaptor 27 in place, the ball is arranged such that the valve with the adaptor therein is in an upper most position whereby any air remaining in the ball may be removed. The adaptor 27 is then again connected to the hose and the filling of the ball is finished.

Figure 1:
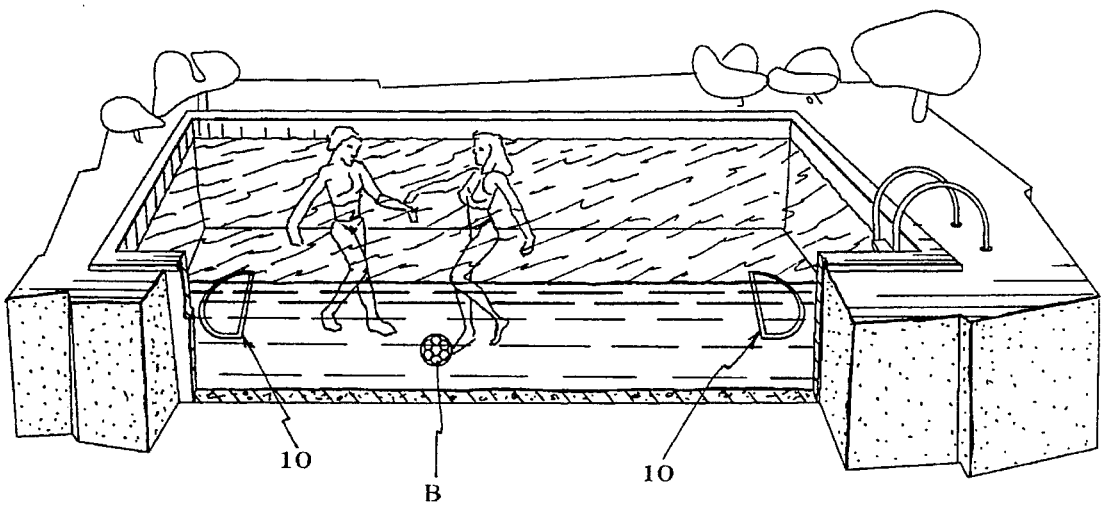
FIG. 1 is a perspective view, partially in cut away, of a swimming pool illustrating placement of the goals and playing of the game.

The goals may then be placed in the pool as shown in FIG. 1 and the ball introduced into the pool.

The game is ideal for between 2 to 4 players with conventional rules being established.

It will be understood that the above described embodiment is for purposes of illustration only and that changes and modifications may be made thereto without departing from the spirit and scope of the invention.

I claim:

1. A game kit comprising first and second goals, each of said first and second goals being formed of a material having a density sufficient to remain on the bottom of a swimming pool, a soccer type ball having a cover surrounding an interior space, valve means associated with said ball to permit the introduction of a fluid therein, and valve adaptor means comprising a member having a first end thereof adapted for introduction into said valve means on said ball and having a fluid outlet proximate said first end, a second end of said valve adaptor means being adapted to be connected to a source of water to thereby permit the introduction of water into the interior of said ball.

2. The kit of claim 1 wherein said second end of said adaptor means has internal threads thereon adapted to screw threadedly mate with a garden hose.

3. The kit of claim 1 wherein each of said goals comprises a substantially flat and planar piece of material adapted to lie on a pool bottom.

4. The kit of claim 3 wherein each of said goals is formed of a rubber material.

5. The kit of claim 1 wherein each of said goals comprises a frame member having netting thereon.

6. A pool game assembly comprising first and second goals, said first and second goals being adapted to sit on the bottom of a pool, a ball, said ball having a cover surrounding an interior space, said ball having said interior space filled with water, said filled ball having a density at least slightly greater than the density of pool water such that the ball will naturally tend to fall to the bottom of the pool.

* * * * *